US006428586B1

(12) United States Patent
Yancey

(10) Patent No.: US 6,428,586 B1
(45) Date of Patent: Aug. 6, 2002

(54) METHOD OF MANUFACTURING A POLYMER OR POLYMER/COMPOSITE POLISHING PAD

(75) Inventor: Paul J. Yancey, Charlotte, NC (US)

(73) Assignee: Rodel Holdings Inc., Wilmington, DE (US)

( * ) Notice: Subject to any disclaimer, the term of this patent is extended or adjusted under 35 U.S.C. 154(b) by 0 days.

(21) Appl. No.: 09/734,089

(22) Filed: Dec. 11, 2000

Related U.S. Application Data

(60) Provisional application No. 60/170,610, filed on Dec. 14, 1999.

(51) Int. Cl.[7] ..... M23B 3/20; B24D 18/00; B24D 17/00

(52) U.S. Cl. ..... 51/297; 51/298; 51/307; 51/296; 51/295; 51/303; 451/451; 451/526; 451/533; 428/314.4; 428/317.9; 428/313.9; 428/313.3; 428/313.5; 428/316.6

(58) Field of Search ..... 51/298, 307, 297, 51/296, 303, 295; 451/526, 533; 428/304.4, 313.3, 313.5, 314.4, 315.5, 317.9, 402.2, 402.21, 316.6

(56) References Cited

U.S. PATENT DOCUMENTS

| | | | | | |
|---|---|---|---|---|---|
| 4,038,047 | A | * | 7/1977 | Haywood | 51/295 |
| 5,863,306 | A | * | 1/1999 | Wei et al. | 51/295 |
| 5,942,015 | A | * | 8/1999 | Culler et al. | 51/295 |
| 5,958,794 | A | | 9/1999 | Bruxvoort et al. | |
| 6,099,954 | A | | 8/2000 | Urbanavage et al. | |

FOREIGN PATENT DOCUMENTS

| | | |
|---|---|---|
| WO | WO 94 04599 | 3/1994 |

* cited by examiner

*Primary Examiner*—Michael Marcheschi
(74) *Attorney, Agent, or Firm*—Gerald K. Kita; Konrad Kaeding; Kenneth A. Benson

(57) ABSTRACT

Manufacture of a polishing pad for polishing a semiconductor substrate, involves, transporting a backing layer to successive manufacturing stations, supplying a fluid phase polymer composition onto the transported backing layer, shaping the fluid phase polymer composition into a surface layer having a measured thickness, and curing the polymer composition on the transported backing layer in a curing oven to convert the liquid phase polymer composition to a solid phase polishing layer attached to the transported backing layer.

22 Claims, 4 Drawing Sheets

METHOD OF MANUFACTURING A POLYMER OR POLYMER/COMPOSITE POLISHING PAD

CROSS REFERENCE TO RELATED APPLICATION

This application claims the benefit of Provisional Application No. 60/170,610 filed Dec. 14, 1999.

FIELD OF THE INVENTION

The invention relates to manufacture of a polymer based polishing pad, particularly a polishing pad used for polishing semiconductor substrates.

BACKGROUND OF THE RELATED ART

U.S. Pat. No 6,099,954 discloses a known method of manufacturing a polishing pad for polishing semiconductor substrates, includes the step of; coagulating a layer of viscous polishing material in-situ, meaning, directly onto, a portion of the manufactured polishing pad. The polishing material is an elastomer or polymer that is coagulated and dried, in situ, on a backing layer in sheet form. The polishing material solidifies and adheres to the backing layer. Prior to the invention, batch processing was performed to manufacture a limited number of polishing pads. The polishing pads that were manufactured by one batch processing varied from those manufactured by another batch processing. A need exists for a manufacturing process that avoids variations in polishing pads that are manufactured according to different batches.

SUMMARY OF THE INVENTION

The invention provides a continuous manufacturing process, which eliminates batch processing and reduces variations among polishing pads that are manufactured according to different batches. A method of manufacturing a polishing pad that is used for polishing a semiconductor substrate, comprises the steps of; transporting a continuous material forming a transported backing layer through successive manufacturing stations, supplying a fluid phase polymer composition onto the transported backing layer, shaping the polymer composition on the transported backing layer into a surface layer having a measured thickness, curing the polymer composition on the transported backing material in a curing oven to convert the polymer composition to a solid phase polymer layer attached to the transported backing layer, the solid phase polymer layer providing a solid phase polishing layer of a polishing pad that is used for polishing semiconductor substrates.

DESCRIPTION OF THE DRAWINGS

Embodiments of the invention will now be described by way of example with reference to the drawings, according to which.

DETAILED DESCRIPTION

Figure 3:
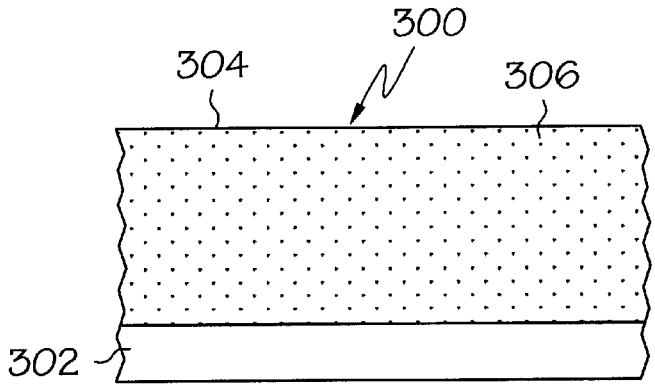
FIG. 3 is a fragmentary cross section of a polishing pad manufactured according to the apparatus disclosed by FIG. 1.

FIG. 3 discloses a portion of a polishing pad (300) of a type having a backing layer (302) to which is adhered, or otherwise attached, an overlying polishing layer (304). Without abrasive particles in the polishing layer (304), the polishing pad (300) is known as an abrasive free pad. According to another embodiment, the polishing pad (300) becomes a fixed abrasive pad entrained with distributed, abrasive particles or particulates (306) in the polishing layer (304). The abrasive free pad is disclosed by FIG. 3, by visualization of the polishing layer (304) without the abrasive particles or particulates (306) therein.

Figure 3A:
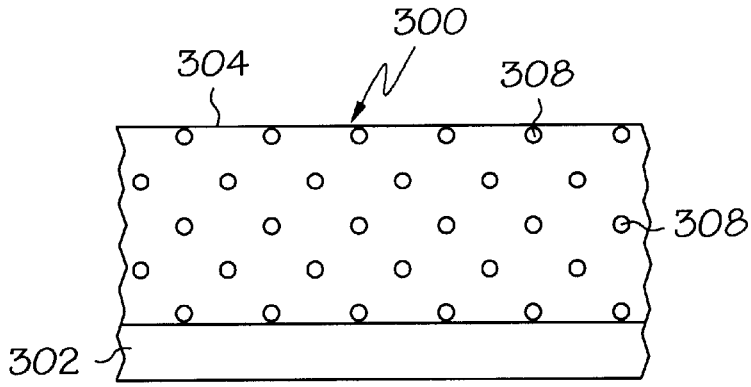
FIG. 3A is a view similar to FIG. 3, and disclosing another polishing pad manufactured according to the apparatus disclosed by FIG. 1.

FIG. 3A discloses a portion of another embodiment of a polishing pad (300) having the backing layer (302) and the polishing layer (304). The polishing layer (302) is entrained with distributed open pores (308) therethrough.

Figure 3B:
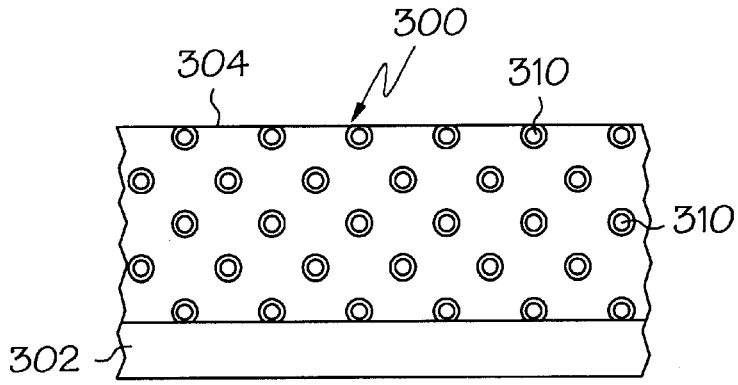
FIG. 3B is a view similar to FIG. 3, and disclosing another polishing pad is manufactured according to the apparatus disclosed by FIG. 1.

FIG. 3B discloses a portion of another embodiment of a polishing pad (300) having the backing layer (302) and the polishing layer (304). The polishing layer (302) is entrained with distributed microelements in the form of hollow shells (310) therethrough. The hollow shells (310) are gas filled, for example, air at atmospheric pressure or greater pressure. Alternatively, the hollow shells (310) are filled with a known polishing fluid that is released by fracture or puncture of the hollow shells (310) during a polishing operation known as CMP, chemical mechanical planarization. The CMP polishing operation uses the polishing pad (300) for polishing semiconductor substrates. The known polishing fluid is released at an interface of the polishing pad (300) and the semiconductor substrate that is being polished.

Figure 1:
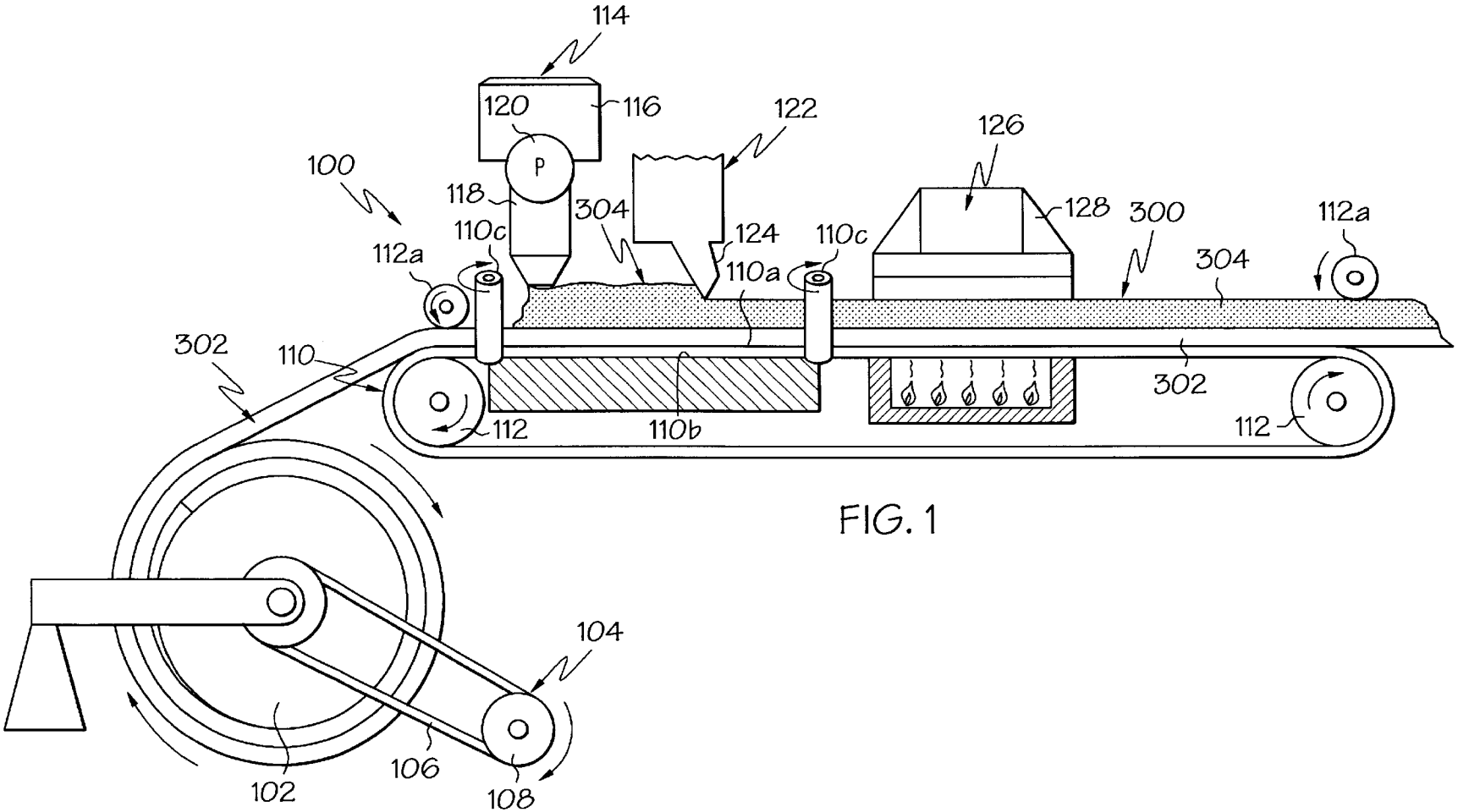
FIG. 1 is a diagrammatic view of apparatus for continuous manufacturing of a continuous form of a polishing pad used for polishing semiconductor substrates.

FIG. 1 discloses apparatus (100) for continuous manufacturing of a polishing pad (300) in continuous form. Continuous manufacturing replaces batch processing. Continuous manufacturing reduces variations among different polishing pads (300) that are caused by batch processing. The apparatus (100) includes a feed reel (102) on which is stored a helically wrapped backing layer (302) in lengthwise continuous form. The backing layer (302) is of nonwoven fiberous material or, alternatively, of an impermeable membrane, such as, a polyester film. The feed roller (102) is mechanically driven to rotate at a controlled speed by a drive mechanism (104). The drive mechanism (104), for example, is disclosed as a belt (106) and motor driven pulley (108), and alternatively includes, for example, a motor driven flexible shaft or a motor driven gear train.

FIG. 1 discloses the continuous backing layer (302) being supplied by the feed reel (102) onto a continuous conveyor (110), for example, a stainless steel belt, that is looped over spaced apart drive rollers (112). The drive rollers (112) are motor driven at a speed that synchronizes linear travel of the conveyor (110) with that of the continuous backing layer (302). The backing layer (302) is transported by and against the conveyor (110) along a space between each drive roller (112) and a corresponding idler roller (112*a*). The idler roller (112*a*) engages the backing layer (302) for positive tracking control of the conveyor (110) and the backing layer (302). The conveyor (110) has a flat section (110*a*) supported on a flat and level surface of a table support (110*b*), which flatly supports the backing layer (302) and transports the backing layer (302) through successive manufacturing stations (114), (122) and (126). Support members (110*c*) in the form of rollers are distributed along the lateral edges of the conveyor (110) and the backing layer (302) for positive tracking control of the conveyor (110) and the backing layer (302).

A first manufacturing station (114) includes a storage tank (116) and a nozzle (118) at an outlet of the tank (116). A viscous, fluid state polymer composition is supplied to the tank (116), and is dispensed by the nozzle (118) onto the continuous backing layer (302). The flow rate of the nozzle (118) is controlled by a pump (120) at the outlet of the tank (116). The nozzle (118) is as wide as the width of the continuous backing layer (302) to cover the backing layer (302) with the polishing layer (304) comprised of the fluid state polymer composition. As the conveyor (110) transports the continuous backing layer (302) past the manufacturing station (114), a continuous, fluid phase polishing layer (304) is supplied onto the backing layer (302).

A second manufacturing station (122) includes a doctor blade (124) located at a precise distance from the continuous backing layer (302) defining a clearance space therebetween. As the conveyor (110) transports the continuous backing layer (302) and the fluid phase polishing layer (304) past the doctor blade (124) of the manufacturing station (122), the doctor blade (124) continuously shapes the fluid phase polishing layer (304) to a precise thickness.

A third manufacturing station (126) includes a curing oven (128) in the form of a heated tunnel through which is transported the continuous backing layer (302) and the polishing layer (304) of precise thickness. The oven (128) cures the fluid phase polishing layer (304) to a continuous, solid phase polishing layer (304) that adheres to the continuous backing layer (302). The cure time is controlled by temperature and the velocity of transport through the oven (128). The oven (128) is fuel fired or electrically fired, using either radiant heating or forced convection heating, or both.

Figure 1A:
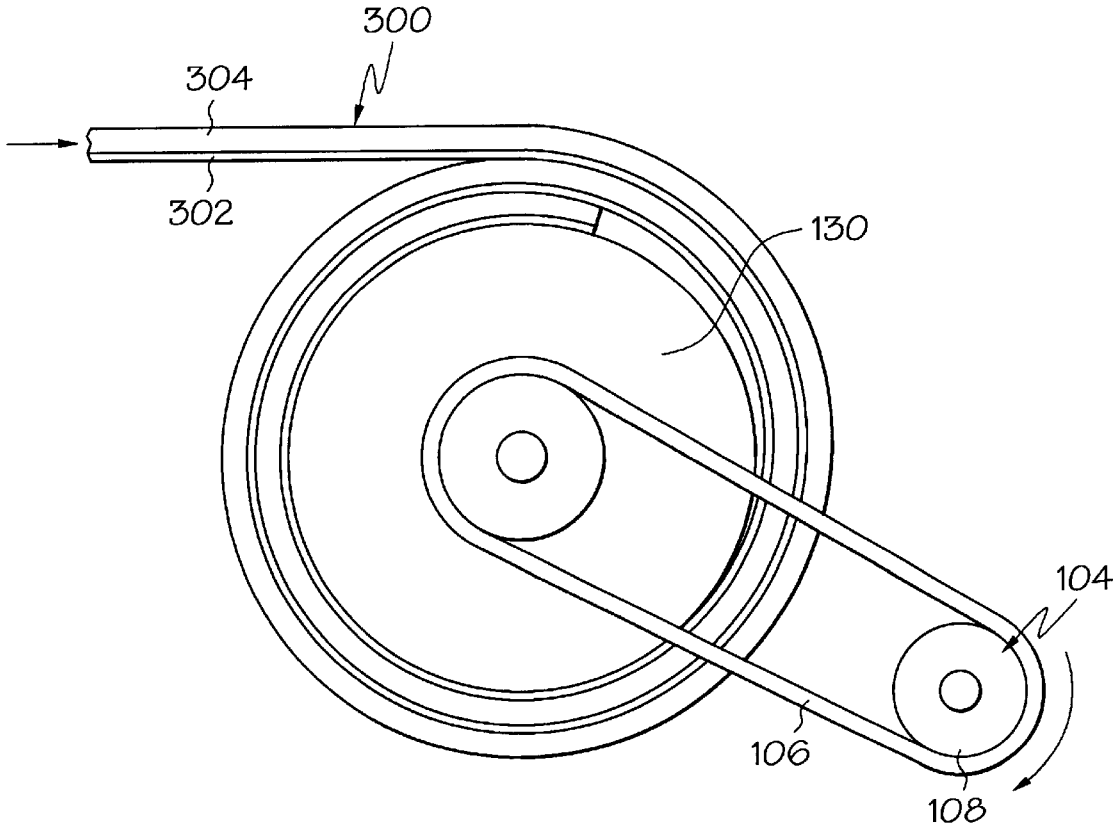
FIG. 1A is a diagrammatic view of a take up reel on which is wound a continuous polishing pad.

Upon exiting the oven (128), the continuous backing layer (302) is adhered to a continuous, solid phase polishing layer (304) to comprise, a continuous polishing pad (300). The continuous polishing pad (300) is rolled helically onto a take up reel (130), FIG. 1A, that successively follows the manufacturing station (126). The take up reel (130) is driven by a second drive mechanism (104). The take up reel (130) and second drive mechanism (104) comprise, a separate manufacturing station that is positioned selectively in the manufacturing apparatus (100).

According to an embodiment of the polishing pad (300) as disclosed by FIG. 3, a high solids constituent in a viscous, fluid state polymer mixture, for example, a latex polymer mixture or a polyurethane polymer mixture, is supplied by the tank (116). According to another embodiment, the polymer mixture includes a constituent that is transparent to a beam of electromagnetic radiation in a wavelength range of about 190 nanometers to about 3500 nanometers for optical monitoring and detection. Upon curing in the oven (128), the polymer mixture forms a solidified, continuous polishing pad (300). Without the abrasive particles or particulates (306) added to the fluid state polymer mixture, the continuous polishing pad (300) is an abrasive free polishing pad (300).

According to another embodiment, the abrasive particles or particulates (306) are included as a constituent in the fluid state polymer mixture. The polymer mixture becomes a matrix that is entrained with the abrasive particles or particulates (306). The continuous polishing pad (300) becomes a fixed abrasive polishing pad (300) having the abrasive particles or particulates (306) distributed throughout the continuous polishing layer (304).

According to an embodiment of the polishing pad (300) as disclosed by FIG. 3A, an entrained constituent in the form of, a foaming agent or blowing agent or a gas, is included in the polymer mixture that serves as a matrix that is entrained with the constituent. Upon curing, the foaming agent or blowing agent or gas escapes as volatiles to provide the open pores (308) distributed throughout the continuous polishing layer (304).

According to an embodiment of the polishing pad (300) as disclosed by FIG. 3B, an entrained constituent in the form of microballons or polymeric hollow shells (310) are included in the polymer mixture, and become distributed throughout the continuous polishing layer (304). The shells (310) are gas filled. Alternatively the shells (310) are filled with a polishing fluid that is dispensed when the shells (310) are opened by abrasion or by fracture or by puncture when the polishing pad (300) is used during a polishing operation known as CMP. Alternatively, the shells (310) are water soluble polymeric microelements that are opened by becoming soluble in water during a polishing operation known as CMP.

Prior to the invention, a batch process method for making latex based polishing pads involved, placing high solids latex polymer mix in a mold, placing the mold in an oven, and then curing the pad in the mold in the oven. Batch processes for making pads resulted in variations in the pads, due to the batch and position variability seen in the batch processes.

Figure 2:
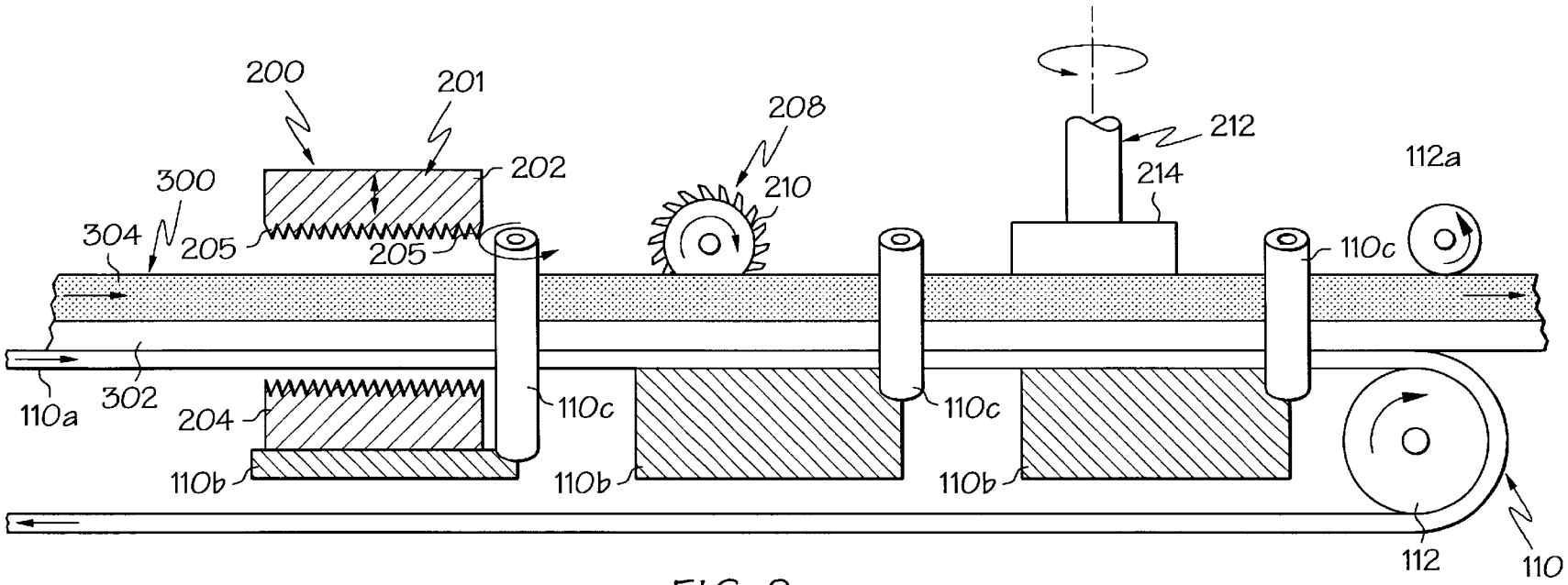
FIG. 2 is a diagrammatic view of apparatus for continuous conditioning of a continuous polishing pad used for polishing semiconductor substrates.

FIG. 2 discloses additional apparatus (200) for surface conditioning or surface finishing of the continuous polishing pad (300). The apparatus (200) includes either a similar conveyor (110) as that disclosed by FIG. 1, or a lengthened section of the same conveyor (110), as disclosed by FIG. 1. The conveyor (110) of apparatus (200) has a drive roller (112), and a flat section (110*a*) supporting the continuous polishing pad (300) that has exited the oven (126). The conveyor (110) of apparatus (200) transports the continuous polishing pad (300) through one, or more than one, manufacturing station (201), (208) and (212), at which the continuous polishing pad (300) is further processed subsequent to curing in the oven (126). The apparatus (200) is disclosed with additional flat table supports (110*b*) and additional support members (110*c*), all of which operate as disclosed with reference to FIG. 1.

The solidified polishing layer (304) is buffed to expose a desired surface finish and planar surface level of the polishing layer (304). Asperities in the form of grooves or other indentations, are worked into the surface of the polishing layer (304). For example, a work station (201) includes a pair of compression forming, stamping dies having a reciprocating stamping die (202) and a fixed die (204) that close toward each other during a stamping operation. The reciprocating die (202) faces toward the surface of the continuous polishing layer (304). Multiple teeth (206) on the die (202) penetrate the surface of the continuous polishing layer (304). The stamping operation provides a surface finishing operation. For example, the teeth (206) indents a pattern of grooves in the surface of the polishing layer (304). Further, for example, the teeth (206) puncture the microballons or hollow shells (310), if any are present in the polymer mixture, at the surface of the continuous polishing layer (304). The conveyor (110) is intermittently paused, and becomes stationary when the dies (202) and (204) close toward each other. Alternatively, the dies (202) and (204)

move in synchronization with the conveyor (110) in the direction of transport during the time when the dies (202) and (204) close toward each other.

Another manufacturing station (208) includes a rotary saw (210) for cutting grooves in the surface of the continuous polishing layer (304). The saw (210) is moved by a known orthogonal motion plotter along a predetermined path to cut the grooves in a desired pattern of grooves.

Another manufacturing station (212) includes a rotating milling head (214) for buffing or milling the surface of the continuous polishing layer (304) to a flat, planar surface with a desired surface finish that is selectively roughened or smoothed. Further, for example, the milling head (214) punctures the microballons or hollow shells (310), if any are present in the polymer mixture, at the surface of the continuous polishing layer (304).

The sequence of the manufacturing stations (202), (210) and (212) can vary from the sequence as disclosed by FIG. 2. One or more than one of the manufacturing stations (202), (210) and (212) can be eliminated as desired. The take up reel (130) and second drive mechanism (104) comprise, a separate manufacturing station that is positioned selectively in the manufacturing apparatus (200) at the end of the conveyor (110) to wrap the solid phase continuous polishing pad (300).

The process is adapted to curing system of a polymer liquid phase to solid phase, according to which a viscous, moldable polymer mixture of the mixture constituents is made. Even a polymer mixture that does not involve a solvent based intermediate step, such as an injection molded polymer mixture, is adapted for the disclosed process by, first, grinding the polymer components to extremely small sizes, dispersing the ground components in a concentrated liquid dispersion, desicating, and then melting the ground components in the oven (128) to coalesce the ground components.

Because the raw materials can be mixed in large homogeneous supply that repeatedly fills the tank (116), variations in composition and properties of the finished product are minimized. The continuous nature of the process enables precise control for manufacturing a continuous polishing pad (300) from which large numbers of individual polishing pads (300) are cut to a desired area pattern and size. The large numbers of individual polishing pads (300) have minimized variations in composition and properties.

What is claimed is:

1. A method of manufacturing a polishing pad that is used for polishing a semiconductor substrate, comprising the steps of:

transporting a continuous material forming a transported backing layer to successive manufacturing stations, supplying a fluid phase polymer composition onto the transported backing layer at a first manufacturing station, shaping the fluid phase polymer composition on the transported backing layer into a surface layer at another manufacturing station, curing the polymer composition on the transported backing layer in a curing oven to convert the polymer composition to a solid phase polymer layer attached to the transported backing layer at another manufacturing station, the solid phase polymer layer providing a solid phase polishing layer of a polishing pad that is used for polishing semiconductor substrates and surface conditioning or surface finishing the polishing pad.

2. The method as recited in claim 1, further comprising the step of: supplying the fluid phase polymer composition as a matrix entrained with particulates.

3. The method as recited in claim 1, further comprising the step of: supplying the fluid phase polymer composition as a matrix entrained with water soluble polymeric microelements.

4. The method as recited in claim 1, further comprising the step of: supplying the fluid phase polymer composition as a matrix entrained with polymeric microelements having polymeric hollow shells.

5. The method as recited in claim 1, further comprising the step of: supplying the fluid phase polymer composition as a matrix entrained with polymeric microelements having polymeric shells containing polishing fluid.

6. The method as recited in claim 1, further comprising the step of: supplying the fluid phase polymer composition as a matrix entrained with abrasive particles.

7. The method as recited in claim 1, further comprising the step of: supplying the fluid phase polymer composition with a constituent providing a solid phase polishing layer having pores.

8. The method as recited in claim 1, wherein the surface conditioning or surface finishing comprises surface finishing the solid phase polymer layer and the backing layer with a rotating milling head.

9. The method as recited in claim 1, wherein the surface conditioning or surface finishing comprises stamping the solid phase polymer layer and the backing layer between a pair of compression forming dies.

10. The method as recited in claim 4, wherein the surface conditioning or surface finishing comprises puncturing hollow shells in the solid phase polymer layer by stamping the solid phase polymer layer and the backing layer between a pair of compression forming dies.

11. A method of manufacturing a polishing pad that is used for polishing a semiconductor substrate, comprising the steps of:

supplying a fluid phase polymer composition onto a continuous transported backing layer, shaping the fluid phase polymer composition on the transported backing layer into a surface layer, curing the polymer composition on the transported backing layer in a curing oven to convert the polymer composition to a solid phase polymer layer of a polishing pad that is used for polishing semiconductor substrates and surface conditioning or surface finishing the polishing pad.

12. The method as recited in claim 11, further comprising the step of: supplying the fluid phase polymer composition as a matrix entrained with particulates.

13. The method as recited in claim 11, further comprising the step of: supplying the fluid phase polymer composition as a matrix entrained with water soluble polymeric microelements.

14. The method as recited in claim 11, further comprising the step of: supplying the fluid phase polymer composition as a matrix entrained with polymeric microelements having polymeric hollow shells.

15. The method as recited in claim 11, further comprising the step of: supplying the fluid phase polymer composition as a matrix entrained with polymeric microelements having polymeric shells containing polishing fluid.

16. The method as recited in claim 11, further comprising the step of: supplying the fluid phase polymer composition as a matrix entrained with abrasive particles.

17. The method as recited in claim 11, further comprising the step of: supplying the fluid phase polymer composition with a constituent providing a solid phase polishing layer having pores.

18. The method as recited in claim 11, wherein the surface conditioning or surface finishing comprises surface finishing the solid phase polymer layer and the backing layer with a rotating milling head.

19. The method as recited in claim 11, wherein the surface conditioning or surface finishing comprises stamping the solid phase polymer layer and the backing layer between a pair of compression forming dies.

20. The method as recited in claim 11, wherein the surface conditioning or surface finishing comprises providing surface asperities in the solid phase polymer layer by stamping the solid phase polymer layer and the backing layer between a pair of compression forming dies.

21. The method as recited in claim 14, wherein the surface conditioning or surface finishing comprises puncturing hollow shells in the solid phase polymer layer by stamping the solid phase polymer layer and the backing layer between a pair of compression forming dies.

22. The method as recited in claim 14, wherein the surface conditioning or surface finishing comprises puncturing hollow shells in the solid phase polymer layer by buffing the solid phase polymer layer.

* * * * *